US009468314B2

(12) United States Patent
Goodwin et al.

(10) Patent No.: US 9,468,314 B2
(45) Date of Patent: Oct. 18, 2016

(54) DISPLAY SYSTEM FOR FLAT ARTICLE

(71) Applicant: ARMSTRONG WORLD INDUSTRIES, INC., Lancaster, PA (US)

(72) Inventors: Milton W. Goodwin, Lancaster, PA (US); Michael S. Ohearn, Mountville, PA (US); Steven R. Brant, Lancaster, PA (US)

(73) Assignee: AFI Licensing LLC, Lancaster, PA (US)

( * ) Notice: Subject to any disclaimer, the term of this patent is extended or adjusted under 35 U.S.C. 154(b) by 0 days.

(21) Appl. No.: 14/721,724

(22) Filed: May 26, 2015

(65) Prior Publication Data

US 2015/0335177 A1 Nov. 26, 2015

Related U.S. Application Data

(60) Provisional application No. 62/002,979, filed on May 26, 2014.

(51) Int. Cl.
*A47F 5/08* (2006.01)
*A47B 47/00* (2006.01)
(Continued)

(52) U.S. Cl.
CPC ..... *A47F 5/0838* (2013.01); *A47B 47/0025* (2013.01); *A47B 47/0083* (2013.01); *A47B 47/05* (2013.01); *A47B 96/067* (2013.01); *A47F 5/10* (2013.01); *A47F 7/0042* (2013.01)

(58) Field of Classification Search
CPC ..... A47F 7/163; A47F 5/08; A47F 7/16; A47F 5/00; A47F 5/0006; A47F 5/0838; A47F 7/0042; A47F 2005/0075; A47F 5/0869; A47F 7/14; A47F 7/146; A47F 7/143; A47F 7/147; A47F 5/10; A47B 47/0083; A47B 47/02; A47B 47/021; A47B 47/025; A47B 47/027; A47B 47/028; A47B 47/042; A47B 47/0058; A47B 47/0025; A47B 47/04; A47B 47/045; A47B 47/05; A47B 47/0075; A47B 2096/209; A47B 96/205; A47B 96/067
USPC ..... 211/41.15, 41.1, 94.01, 87.01, 180, 211/189, 183, 162, 186, 191; 312/139.2, 312/234, 114, 265.1–265.6; 248/215, 298.1
See application file for complete search history.

(56) References Cited

U.S. PATENT DOCUMENTS 949,915 A * 2/1910 Schreiber ..... A47F 7/0042 211/169
3,360,136 A * 12/1967 Ain ..... A47F 7/0042 211/162

(Continued)

*Primary Examiner* — Joshua Rodden
*Assistant Examiner* — Hiwot Tefera

(57) ABSTRACT

The present invention provides a display system for flat articles generally including a rack, one or more carriers, and a plurality of flat articles. The rack comprises a plurality of vertical rack supports and a plurality of horizontal rack supports forming bays between the vertical rack supports. The one or more carriers have an upper mounting bracket, a lower mounting bracket, a pair of upright members, and at least one pair of support members, and are attached to upper and lower horizontal rack supports within each bay. The pair of upright members are coupled to each of the upper and lower mounting brackets in a horizontally spaced-apart manner, and the pair of support members extends between the pair of upright members in a vertically spaced-apart manner. The plurality of flat articles may be slidably engaged with the pair of support members so that a front surface is exposed for viewing.

13 Claims, 15 Drawing Sheets

(51) Int. Cl.

| | |
|---|---|
| ***A47B 47/05*** | (2006.01) |
| ***A47F 5/10*** | (2006.01) |
| ***A47F 7/00*** | (2006.01) |
| ***A47B 96/06*** | (2006.01) |

(56) References Cited

U.S. PATENT DOCUMENTS

| | | | | |
|---|---|---|---|---|
| 3,833,279 | A * | 9/1974 | MacKenzie, Jr. | A47B 47/05 312/140 |
| 4,634,010 | A * | 1/1987 | Otema | A47F 7/24 211/103 |
| 4,685,573 | A * | 8/1987 | Ovitz, III | A47F 7/163 211/162 |
| 5,224,610 | A * | 7/1993 | Veazey | A47F 5/0846 211/162 |
| 5,509,541 | A * | 4/1996 | Merl | A47B 45/00 211/103 |
| 5,511,332 | A * | 4/1996 | Sturkie | G09F 15/0068 248/223.41 |
| 6,508,449 | B2 * | 1/2003 | Veazey | A47F 5/0846 211/87.01 |
| 7,100,780 | B1 * | 9/2006 | VanCalbergh | A47F 3/004 211/94.01 |
| 7,185,460 | B2 * | 3/2007 | Corden | E04B 2/7453 52/220.7 |
| 7,950,536 | B2 | 5/2011 | Arradondo et al. | |
| 9,072,381 | B2 * | 7/2015 | Bates | A47B 95/008 |
| 9,148,614 | B2 * | 9/2015 | Szolyga | H04N 5/64 |
| 2002/0108330 | A1 * | 8/2002 | Yu | E04B 2/7433 52/238.1 |
| 2002/0158034 | A1 * | 10/2002 | Denny | A47B 47/021 211/189 |
| 2003/0208973 | A1 * | 11/2003 | Corden | E04B 2/7453 52/241 |
| 2004/0007550 | A1 | 1/2004 | Leeman et al. | |
| 2005/0102918 | A1 * | 5/2005 | Richardson | A47F 3/004 52/79.1 |
| 2008/0093319 | A1 * | 4/2008 | Stover | A47B 97/001 211/85.26 |
| 2010/0159160 | A1 | 6/2010 | Basile et al. | |
| 2010/0258696 | A1 * | 10/2010 | Cheng | F16M 13/02 248/297.31 |
| 2012/0080985 | A1 * | 4/2012 | Alarcon | A47F 5/00 312/234 |
| 2013/0148324 | A1 * | 6/2013 | Szolyga | F16M 13/02 361/809 |
| 2013/0168335 | A1 * | 7/2013 | Gillespie | F16M 11/041 211/26 |
| 2014/0319988 | A1 | 10/2014 | Dietz et al. | |

* cited by examiner

DISPLAY SYSTEM FOR FLAT ARTICLE

CROSS-REFERENCE TO RELATED APPLICATIONS

The present application claims the benefit of U.S. Provisional Patent Application Ser. No. 62/002,979, filed May 26, 2014. The disclosure of the above application is incorporated herein by reference.

BACKGROUND

Numerous types of flat article display systems have been used in retail locations to display samples of flooring and other materials. Some systems display flat articles by binding the flat articles such that customers may flip through the flat articles to select their desired pattern, style, or color. Other systems display flat articles by layering them at an angle and stacking the flat articles vertically to permit viewing of an edge of each of the flat articles. These systems suffer from the inability to display large numbers of samples and give the customer an immersive experience that allows them to appreciate the appearance of the product as it would look when installed. Thus, there is a need for an improved flat article display system which overcomes these disadvantages.

BRIEF SUMMARY

The present invention provides a display system for flat articles generally including a rack, one or more carriers, and a plurality of flat articles. The rack comprises first and second vertical rack supports and first upper and lower horizontal rack supports forming a bay. The rack may be extended by adding additional vertical rack supports to create additional bays as desired. The one or more carriers have an upper mounting bracket, a lower mounting bracket, a pair of upright members, and at least one pair of support members, and are attached to the upper and lower horizontal rack supports within each bay. The pair of upright members are coupled to each of the upper and lower mounting brackets in a horizontally spaced-apart manner, and the pair of support members extends between the pair of upright members in a vertically spaced-apart manner. The plurality of flat articles may be slidably engaged with the pair of support members so that a front surface is exposed for viewing.

By arranging one or more carriers across a plurality of bays, it is possible to assemble a continuous wall of flat articles that are substantially co-planar. The flat articles may be flooring products such as tiles, planks, laminate, or other flooring materials known in the art. In one embodiment, the flat articles are wood panel. Further, the flat articles are supported by the carrier such that they do not interfere with the rack once installed. Thus, the wall may extend across multiple bays, such that there are no interruptions in the display. Individual flat articles may span multiple carriers. This permits the display of a plurality of styles, colors, and patterns of flooring material without interruption, providing a more immersive display experience.

In one embodiment, the flat article display system generally includes a rack, one or more carriers, and a plurality of flat articles. The rack comprises first and second vertical rack supports and first upper and lower horizontal rack supports. The vertical rack supports are horizontally spaced-apart to define a bay therebetween. The first upper and lower horizontal rack supports are coupled to and extend between the first and second vertical rack supports, with the first upper and lower horizontal rack supports spaced-apart vertically. The one or more carriers have an upper mounting bracket, a lower mounting bracket, a pair of upright members, and at least one pair of support members. The upper mounting bracket of the one or more carriers is coupled to the first upper horizontal rack support, and the lower mounting bracket is coupled to the first lower mounting bracket. The pair of upright members is coupled to each of the upper and lower mounting brackets in a horizontally spaced-apart manner, and the pair of support members extends between the pair of upright members in a vertically spaced-apart manner. The plurality of flat articles are mounted to the pair of support members so that a front surface is exposed for viewing.

In another embodiment, the flat article display system includes a rack, a plurality of carriers, and a plurality of flat articles. The rack has a first, second, and third vertical rack support arranged in a horizontally spaced-apart manner to define a first bay between the first and second vertical rack supports and a second bay between the second and third vertical rack supports. The plurality of carriers each comprise a pair of upright members arranged in a horizontally spaced-apart manner and a first pair of support members extending between the pair of upright members in a vertically spaced-apart manner. A first one of the carriers is mounted to the rack in the first bay on one side of the second vertical rack support and a second one of the carriers is mounted to the rack in the second bay on an opposite side of the second vertical rack support such that the first pairs of support members of the first and second ones of the carriers are in horizontal alignment.

In another embodiment, the flat article display system includes a rack and a plurality of flat articles mounted to the rack. The rack comprises a first bay and a second bay separated from one another by a vertical rack support. The plurality of flat articles have a first side edge, a second side edge, and a front surface. The flat articles are arranged in a continuous row of flat articles. This row of flat articles extends across at least a portion of the first and second bays and at least partially conceals the vertical rack support of the rack.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION

The following description of the preferred embodiment(s) is merely exemplary in nature and is in no way intended to limit the invention, its application, or uses.

As used throughout, ranges are used as shorthand for describing each and every value that is within the range. Any value within the range can be selected as the terminus of the range. In addition, all references cited herein are hereby incorporated by referenced in their entireties. In the event of a conflict in a definition in the present disclosure and that of a cited reference, the present disclosure controls.

Figure 1:
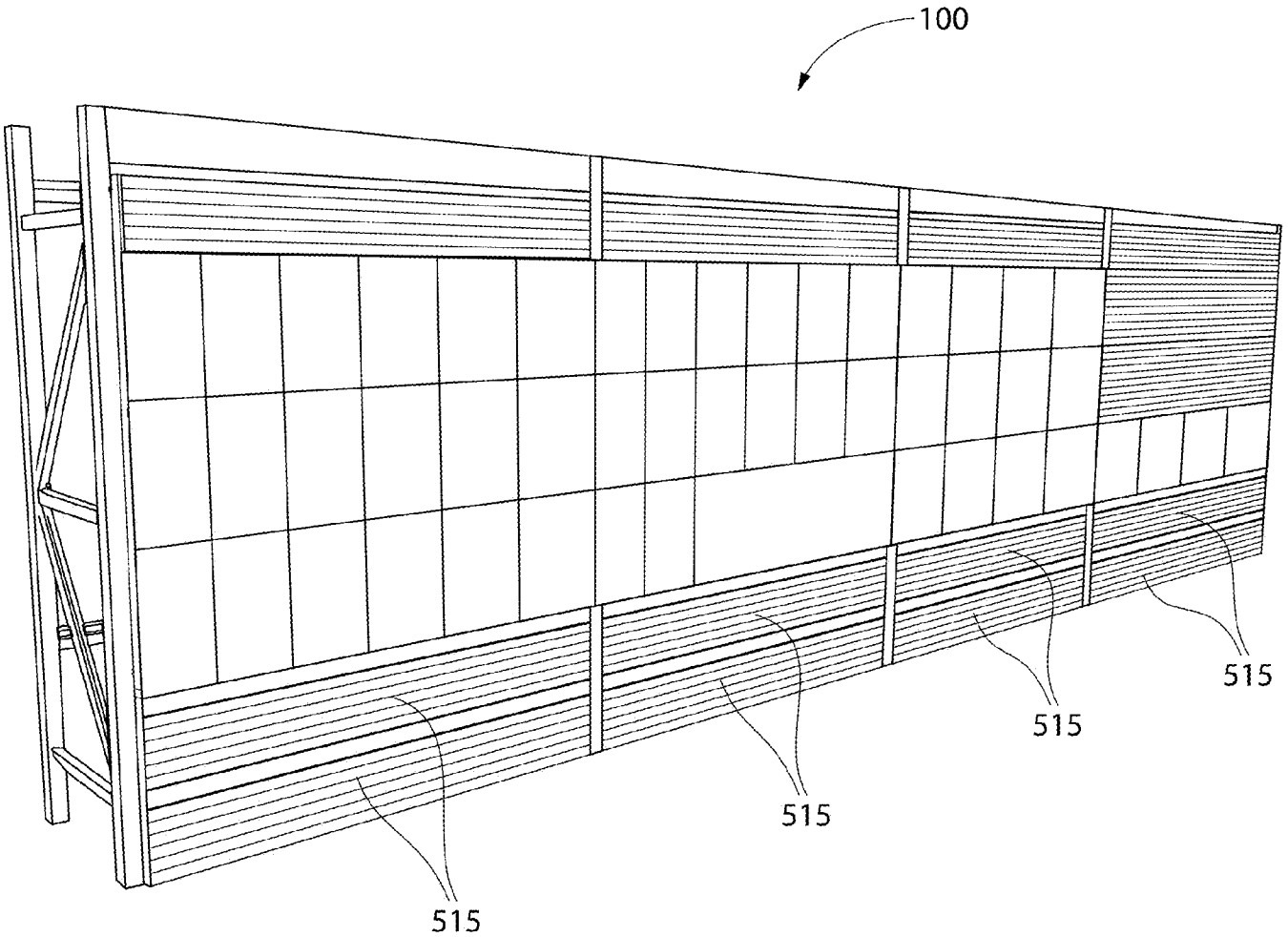
FIG. 1 is a perspective view of the flat article display system according to the present disclosure.
Figure 2:
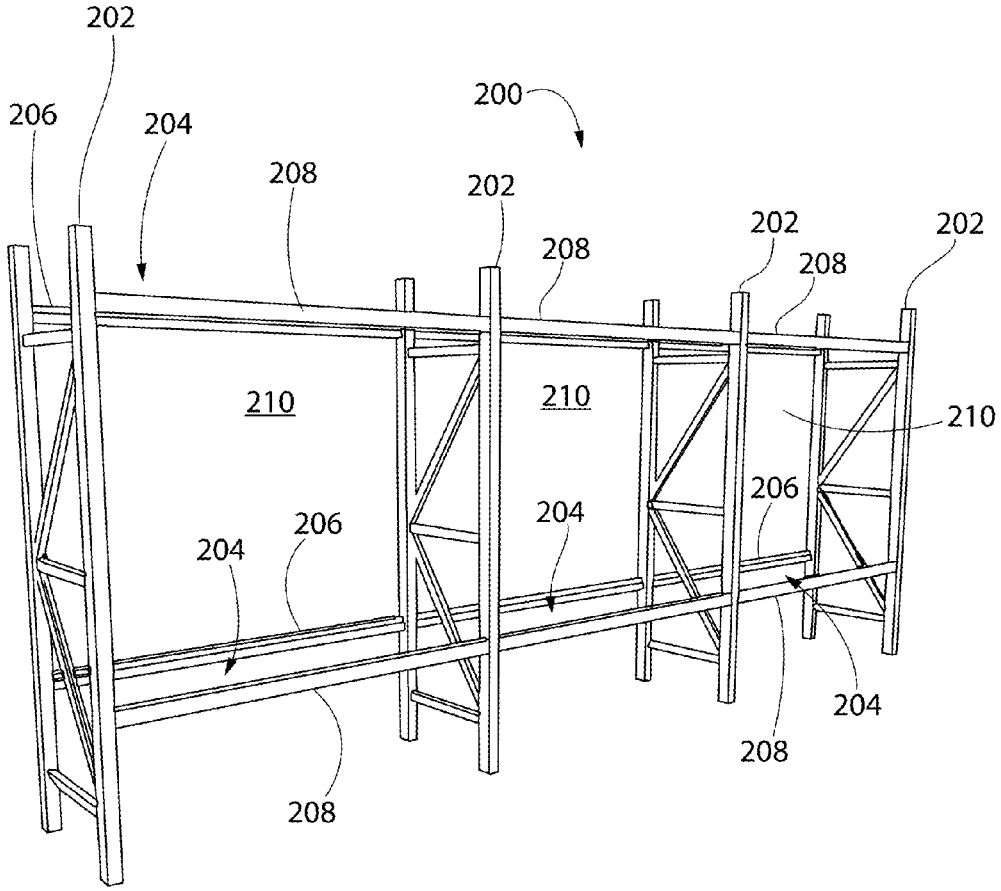
FIG. 2 is a perspective view of a rack thereof having three bays.

FIGS. 1-12 depict an exemplary embodiment of the flat article display system 100 according to the present disclosure. As can be best seen in FIG. 12, the flat article display system 100 comprises a rack 200, one or more carriers 300, and a plurality of flat articles 400. Turning to FIG. 2, the rack 200 is constructed of vertical rack supports 202 arranged in a horizontally spaced-apart manner and coupled to horizontal rack supports 204. The horizontal rack supports 204 comprise a front cross-beam 206 and a rear cross-beam 208, only a front cross-beam 206, or only a rear cross-beam 208. The space between any two adjacent vertical rack supports 202 is known as a bay 210. Typically, at least two horizontal rack supports 204 consisting of both front and rear cross-beams 206, 208 are used to ensure that the vertical rack supports 202 are incapable of being moved relative to one another. Additional vertical rack supports 202 may be added to form additional bays 210 as shown. The height of the horizontal rack supports 204 may be adjusted in discrete increments according to user requirements, and the horizontal rack support heights need not be equal in adjacent bays.

Figure 5:
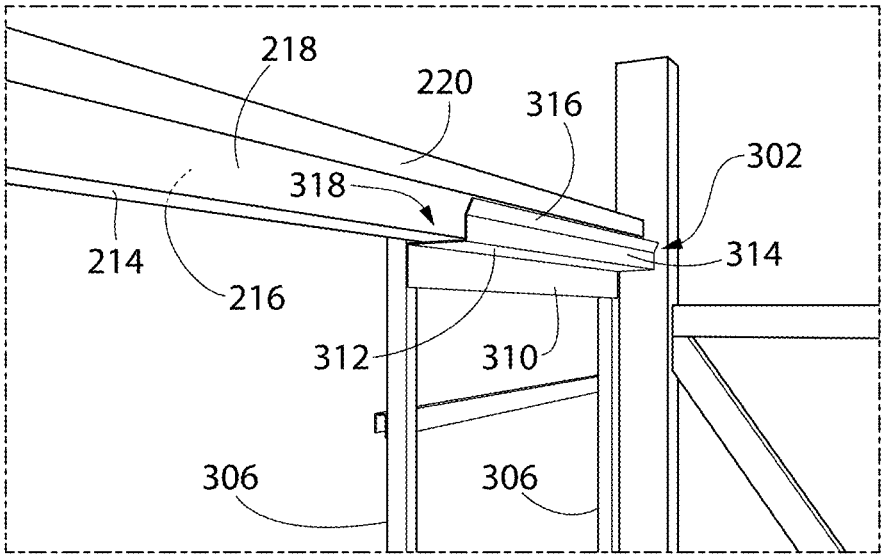
FIG. 5 is an enlarged perspective view of the upper mounting bracket of the carrier installed on the rack thereof.
Figure 6:
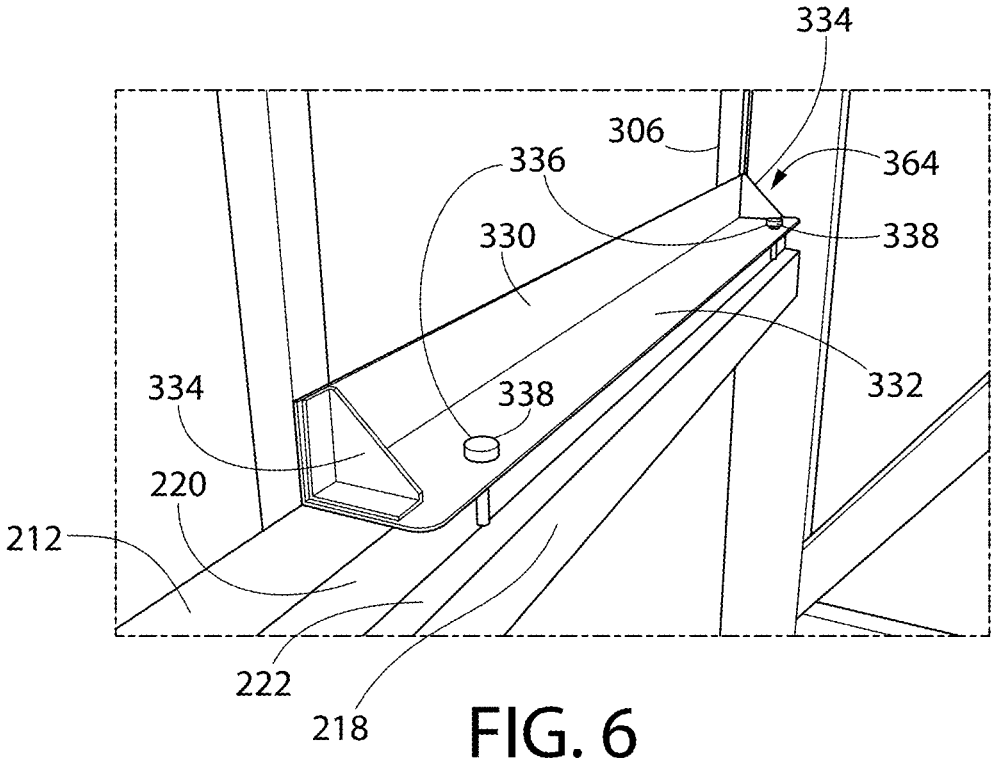
FIG. 6 is an enlarged perspective view of the lower mounting bracket of the carrier installed on the rack thereof.

As best seen in FIGS. 5 and 6, the front and rear cross-beams 206, 208 of the exemplary embodiment are constructed so that they have a stepped profile. The front and rear cross-beams 206, 208 have a top 212, a bottom 214, a front 216, a back 218, a vertical stepped wall 220, and a horizontal stepped wall 222. In alternate embodiments, the stepped profile may be omitted in favor of a rail, rectangular profile, circular profile, or any other profile capable of serving the function of a cross-beam of a rack.

Figure 4:
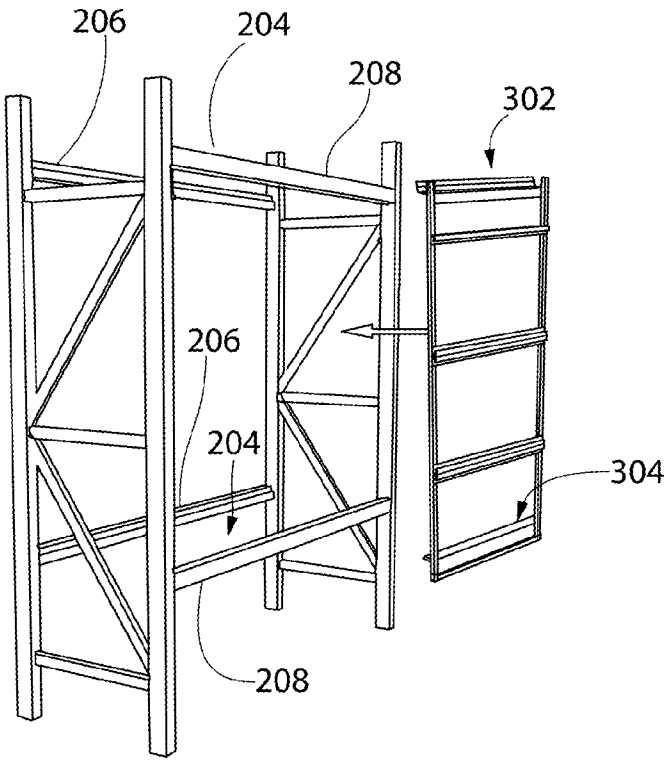
FIG. 4 is a perspective view of a carrier as it would be installed on a bay of the rack of FIG. 2.
Figure 3:
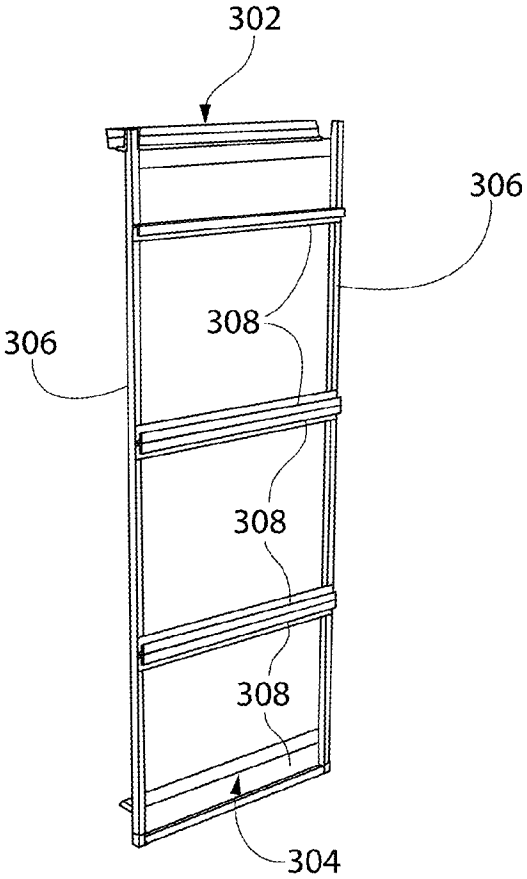
FIG. 3 is a perspective view of a carrier thereof.

Turning to FIGS. 3 and 4, the carriers 300 comprise an upper mounting bracket 302, a lower mounting bracket 304, a pair of upright members 306, and one or more pairs of support members 308. The upper and lower mounting brackets 302, 304 are coupled to horizontal rack supports 204 that are vertically spaced-apart. Specifically, the upper mounting bracket 302 is coupled to a front cross-beam 208 of an upper horizontal rack support 204 and the lower mounting bracket 304 is coupled to a front cross-beam 208 of a lower horizontal rack support 204. Additional horizontal rack supports 204 may be coupled to the vertical rack supports 202, but these are not required to support the carrier 300.

As best seen in FIG. 5, the upper mounting bracket 302 of the carrier 300 is formed with a back wall 310, a horizontal wall 312, a vertical wall 314, and an oblique wall 316. Collectively, these form an upper channel member 318. The oblique wall 316 helps to ensure engagement of the front cross-beams 208 of the horizontal rack supports 204 during sliding installation of the carrier 300. The oblique wall 316 may be angled with respect to the vertical wall 314 at any angle from 0 to 30 degrees, most preferably between 5 and 20 degrees. In alternate embodiments, the upper mounting bracket 302 may be formed as a u-shaped channel, a pair of u-shaped protrusions, or any other form which engages the front cross-beam 208. Alternately, the upper mounting bracket 302 may be omitted entirely and the carrier 300 may be screwed or bolted to the horizontal rack supports 204. Numerous other attachment means may also be used, as would be apparent to one of skill in the art.

As best seen in FIG. 6, the lower mounting bracket 304 of the carrier 300 has a back wall 330 and a horizontal wall 332. The horizontal wall 332 rests on the top 212 of the front cross-beam 208 of a horizontal rack support 204. The lower mounting bracket 304 has reinforcement members 334 to provide additional strength and rigidly support the carrier 300 when it is installed. The lower mounting bracket 304 is also provided with a fastening element 336 such as a pair of bolts 338 which are threaded through the horizontal wall 332 and clamp onto the horizontal stepped wall 222, preventing undesired removal of the carrier 300 from the rack 200. The fastening element 336 may be alternated between an unlocked state in which the lower mounting bracket 304 can be separated from the lower front cross-beam 208, and a locked state in which the lower mounting bracket 304 is fixed to the lower front cross-beam 208. The lower mounting bracket 304 need not have a right angle shape as shown in the preferred embodiment, and instead may have a variety of profiles suitable for engaging the front cross-beam 208 of the rack 200. In alternate configurations, the lower mounting bracket 304 may also be omitted entirely, and the carrier 300 may be screwed or bolted directly to the horizontal rack supports 204. Yet further embodiments may reverse the top and bottom mounting bracket 302, 304 or alter the top and bottom mounting bracket 302, 304 such that the fastening means 336 are located in the top mounting bracket 302 instead of the bottom mounting bracket 304. Numerous other attachment means may also be used, as would be apparent to one of skill in the art, including attachment to only one horizontal rack support 204.

As best seen in FIG. 3, the upright members 306 are coupled to the upper mounting bracket 302 and the lower mounting bracket 304 in a horizontally spaced-apart manner. In alternate embodiments, the carrier 300 may be coupled only to the upper or lower horizontal rack support 204. The first pair of support members 308 extend between the upright members 306 and are vertically spaced-apart. Additional pairs of support members 308 may also extend between the upright members 306 of the carrier 300 as desired. In the preferred embodiment, the upright members 306 are substantially parallel to each other and substantially perpendicular to the horizontal rack supports 204. The support members 308 are substantially perpendicular to the upright members 306.

Figure 7:
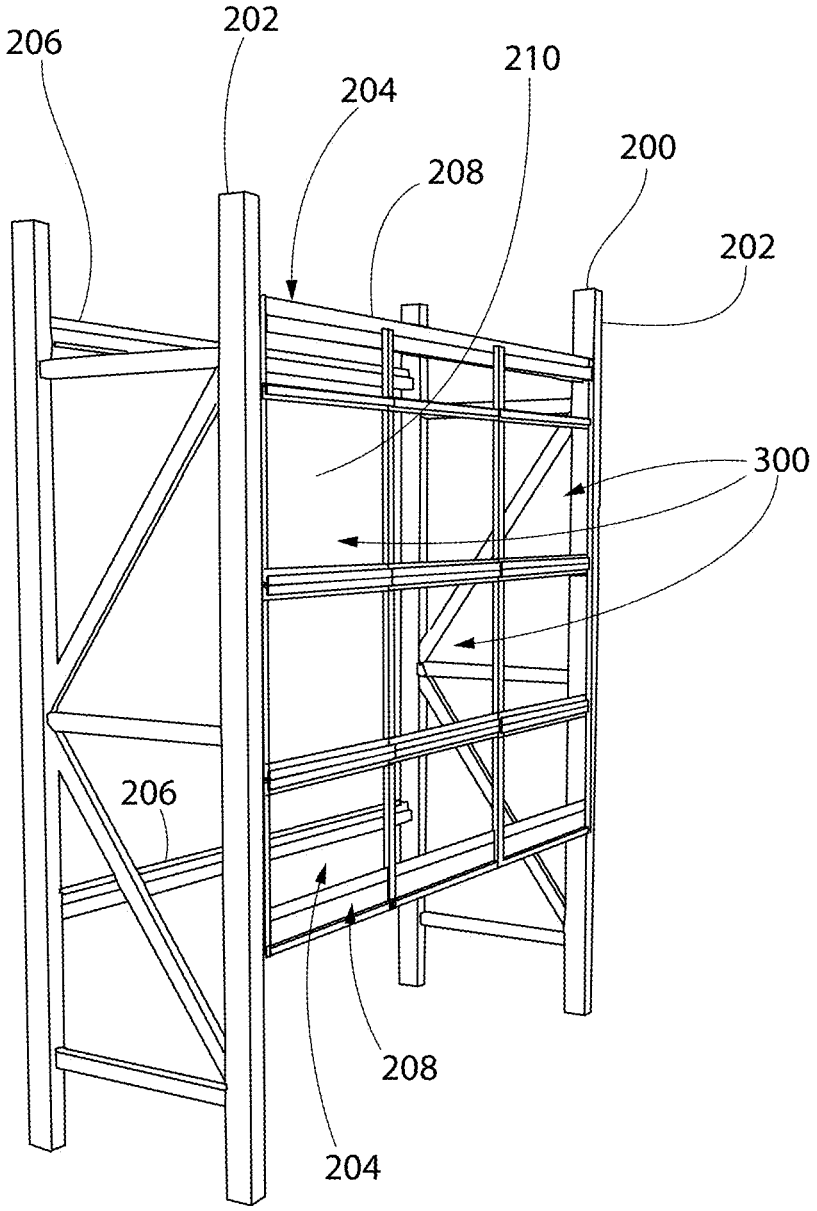
FIG. 7 is a perspective view of three carriers installed on a single bay rack.
Figure 8:
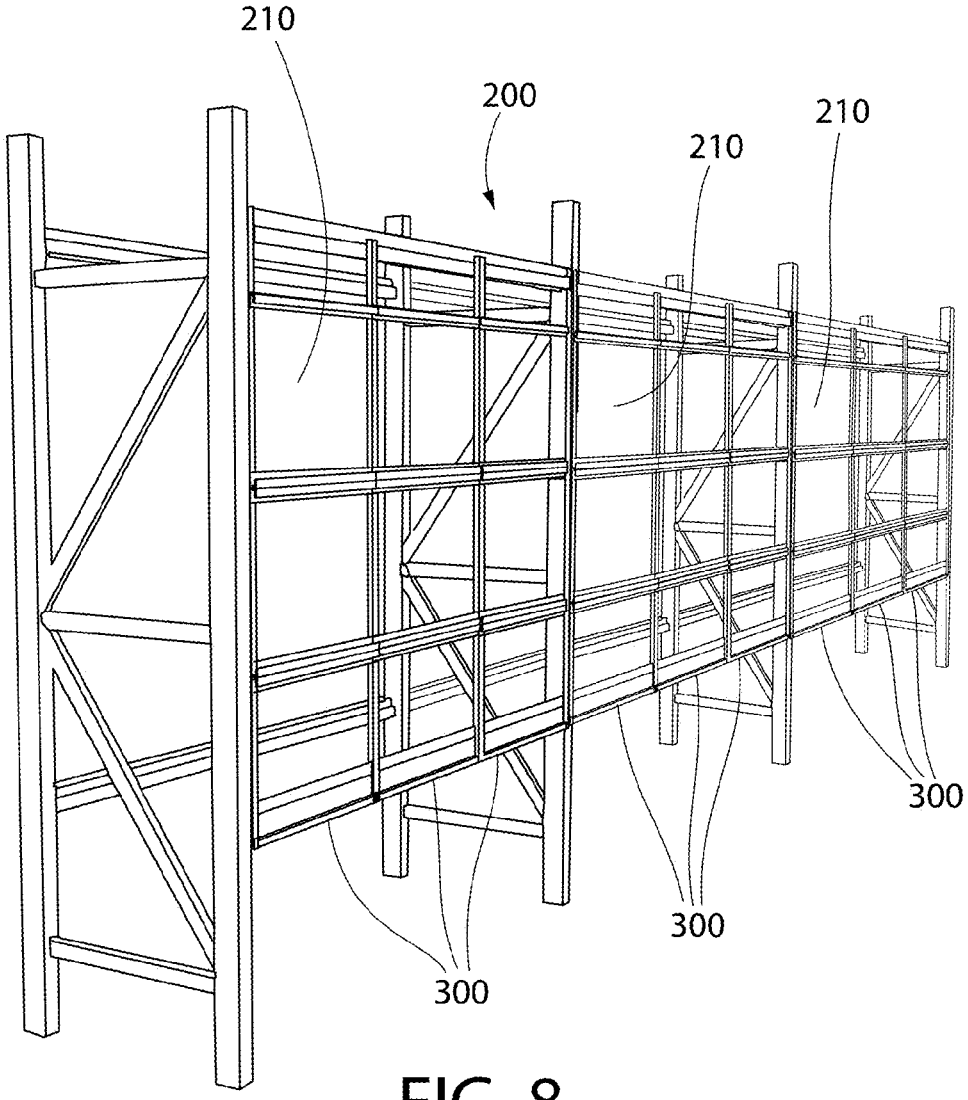
FIG. 8 is a perspective view of nine carriers installed on a three bay rack.
Figure 15A:
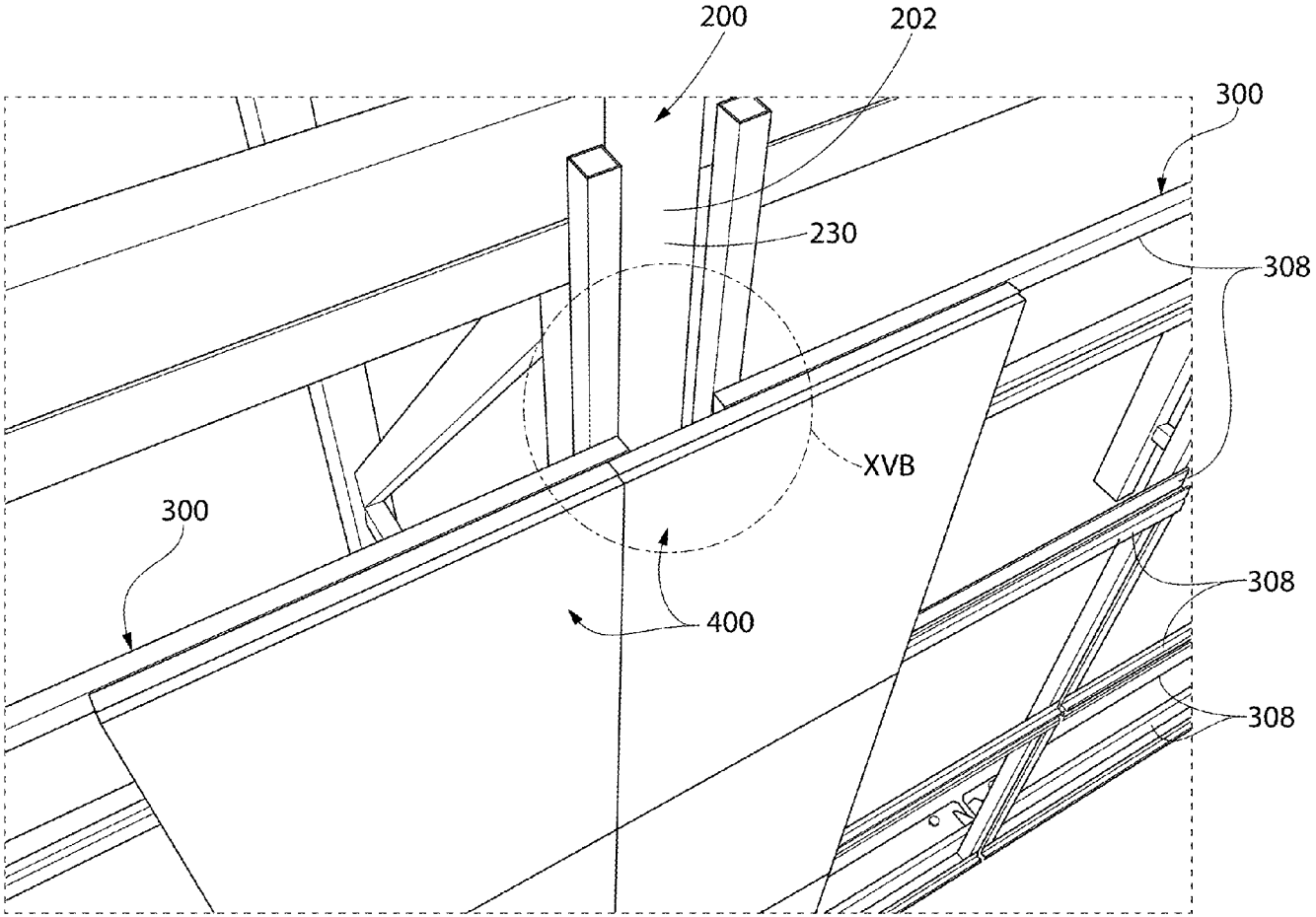
FIG. 15A is top perspective view showing the partial concealment of a vertical rack support.
Figure 15B:
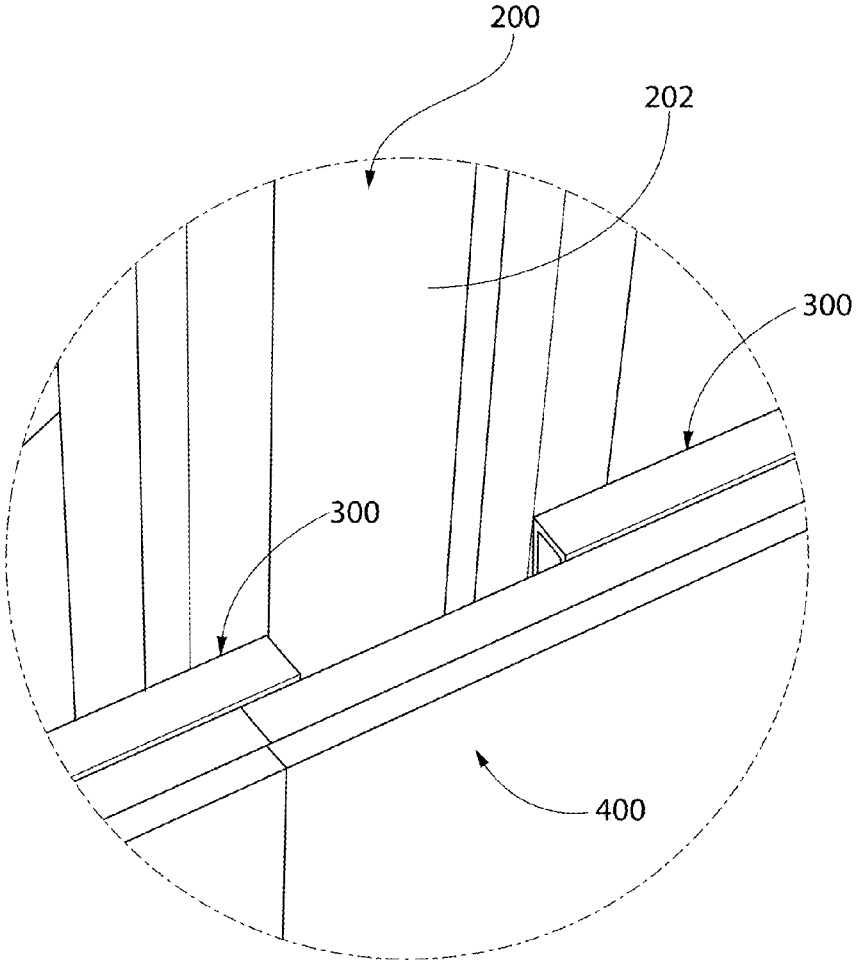
FIG. 15B is an enlarged top perspective view showing a flat article spanning multiple carriers.

Referring to FIG. 7, each bay 210 has three carriers 300. In alternate embodiments, there may be a single carrier 300 in each bay 210. Carriers 300 may also have more than two upright members 306, particularly if wide carriers 300 are used. It is possible that carriers 300 of multiple widths may be used to permit any size display that the user wishes. The carriers 300 do not need to abut each other, and may be separated by gaps between the flat articles 400. As best shown in FIGS. 15A and 15B, the flat articles 400 may span the gap between the carriers 200, permitting more flexible arrangement of carriers 300 when constructing a display of flat articles 400.

Figure 9:
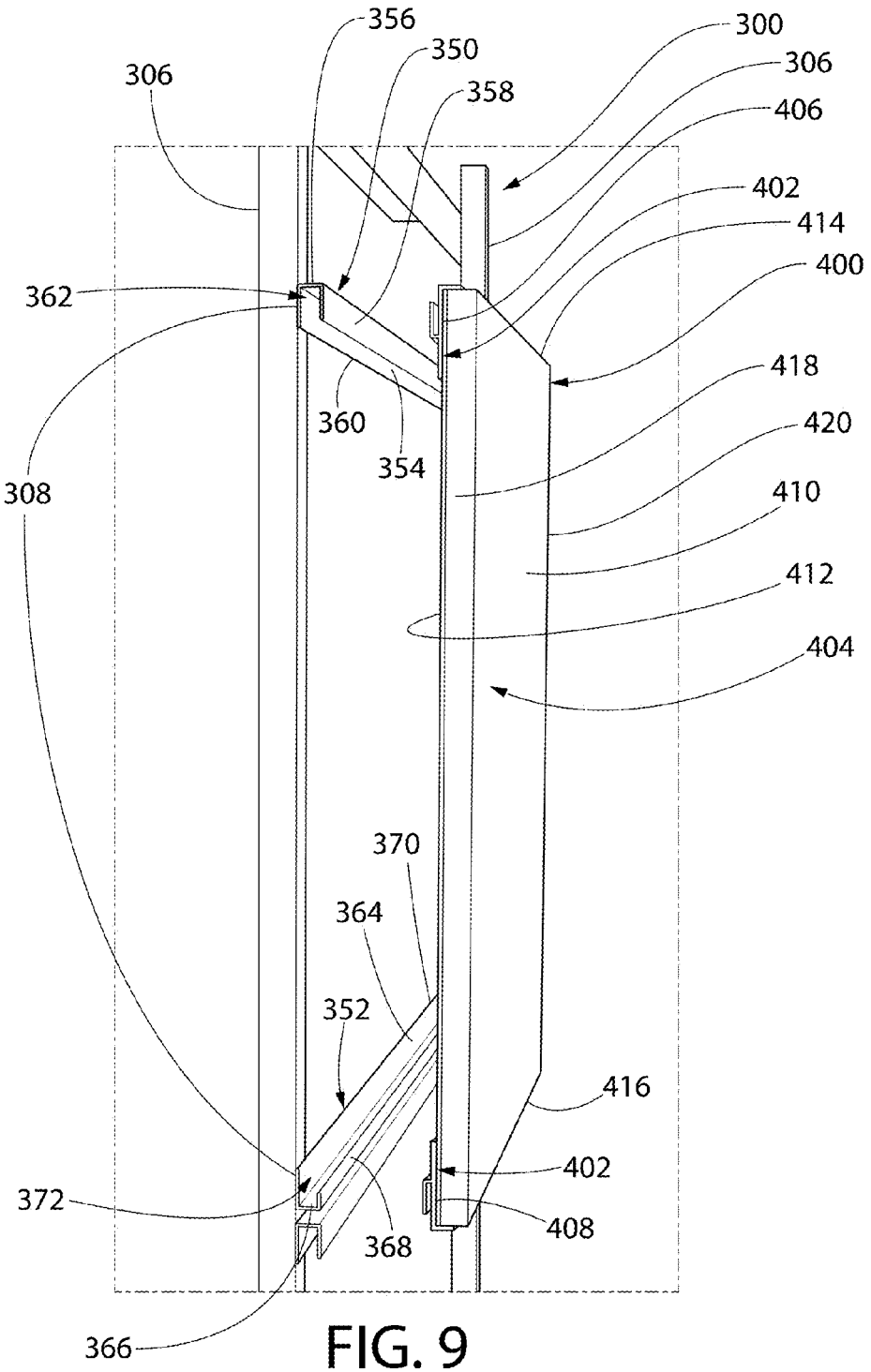
FIG. 9 is an enlarged perspective view of a carrier and a flat article.
Figure 10:
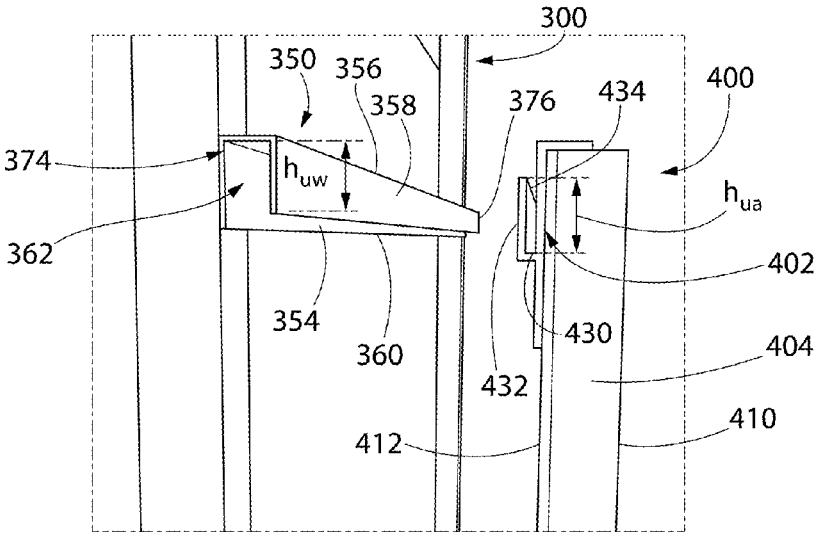
FIG. 10 is an enlarged perspective view showing an upper support member of a carrier and an upper channel member of a flat article.
Figure 11:
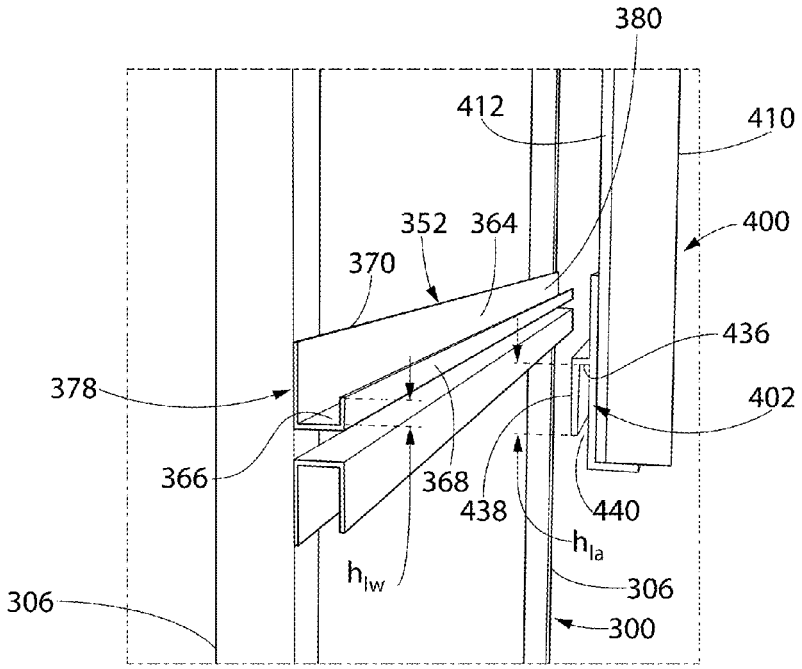
FIG. 11 is an enlarged perspective view showing a lower support member of a carrier and an upper channel member of a flat article.

Referring to FIGS. 9-11, the pairs of support members 308 comprise an upper engagement member 350 and a lower engagement member 352. The upper engagement member 350 has a back wall 354, a roof 356, a downwardly extending engagement wall 358, and an open bottom 360. Collectively, the back wall 354, roof 356, downwardly extending engagement wall 358, and the open bottom 360 form an upper channel 362. Similarly, the lower engagement member 352 has a back wall 364, a floor 366, an upwardly extending engagement wall 368, and an open top 370 that collectively form a lower channel 372. The upper channel 360 and the lower channel 372 extend from a first open side 374 of the carrier 300 to a second open side 376 of the carrier 300.

The height of the downwardly extending engagement wall 358, as measured from the lower side of the roof 356 to the lowermost edge of the downwardly extending engagement wall 358, is a first height huw. The height of the upwardly extending engagement wall 368, as measured from the upper side of the floor 366 to the lowermost edge of the upwardly extending engagement wall 368, is a second height hlw. The first height huw is greater than the second height hlw for each of the pairs of support members. In alternate embodiments, the upper and lower engagement members 350, 352 may be constructed as bars with a rectangular or circular cross section, rails, or any other profile. The upper engagement member 350 does not need to have a downwardly extending engagement wall 358 and the lower engagement member 352 does not need to have an upwardly extending engagement wall 368, but instead the upper and lower engagement members 350, 352 may merely consist of a circular profile, rectangular profile, or any other shape that supports and retains the flat articles 400.

The flat articles 400 of the exemplary embodiment comprise a pair of product mounting elements 402 and a display material 404. The pair of product mounting elements 402 comprise an upper channel member 406 and a lower channel member 408. The display material 404 has a front face 410, a back face 412, a top edge 414, a bottom edge 416, a first side edge 418, and a second side edge 420. The second side edge 420 is opposite the first side edge 418. When installed in the carrier 300, the front face 410 is oriented away from the rack 200 so that the display material 404 can be inspected by customers. The upper channel member 406 and the lower channel member 408 are attached to the back face 412 of the display material 404, such that the upper and lower channel members 406, 408 are hidden from the customers' view when they are inspecting the display material 404. The upper channel member 406 consists of a floor 430, an upwardly extending engagement wall 432, and an open top 434. The upwardly extending engagement wall 432 has a first height hua as measured from the upper surface of the floor 430. The lower channel member 408 consists of a roof 436, a downwardly extending engagement wall 438, and an open bottom 440. The downwardly extending engagement wall 438 has a second height hla as measured from the lower surface of the roof 436. In the exemplary embodiment, the first height hua is equal to the second height hla but alternate embodiments may be designed so that the first height hua is greater than the second height hla.

In the exemplary embodiment, the flat articles 400 are installed into a carrier 300 by positioning the upper channel member 406 of the flat article 400 such that the upper channel member 406 engages the upper engagement member 350 of the carrier 300. This is done by inserting the upwardly extending wall 432 of the upper channel member 406 into the open bottom 360 of the upper engagement member 350. The bottom edge 416 of the flat article 400 is then moved toward the rack 200, and the flat article 400 is slid upward until the lower channel member 408 clears the lower engagement member 352. The bottom edge 416 of the flat article 400 is then pushed against the carrier 300 and the flat article 400 is allowed to slide downward, interlocking the lower channel member 408 with the lower engagement member 352. The flat article 400 remains securely fastened in the carrier 300. Because the first height huw of the downwardly extending engagement wall 358 of the upper engagement member 350 greater than the second height hlw of the upwardly extending engagement wall 368 of the lower engagement member 352, the flat articles 400 may be interlocked without tools or other latching mechanisms. In alternate embodiments, the heights huw, hlw of the upper and lower channel members 406, 408 may be varied to permit interlocking while the heights of the downwardly and upwardly extending engagement walls 358, 368 of the upper and lower engagement members 350, 352 may be kept equal. In yet other embodiments, the upper and lower engagement members 350, 352 need not be formed to have downwardly and upwardly extending engagement walls 358, 368, and may be formed as bars, rails, or any other profile shape which is capable of engaging the upper and lower channel members 406, 408 of the flat articles.

Figure 12:
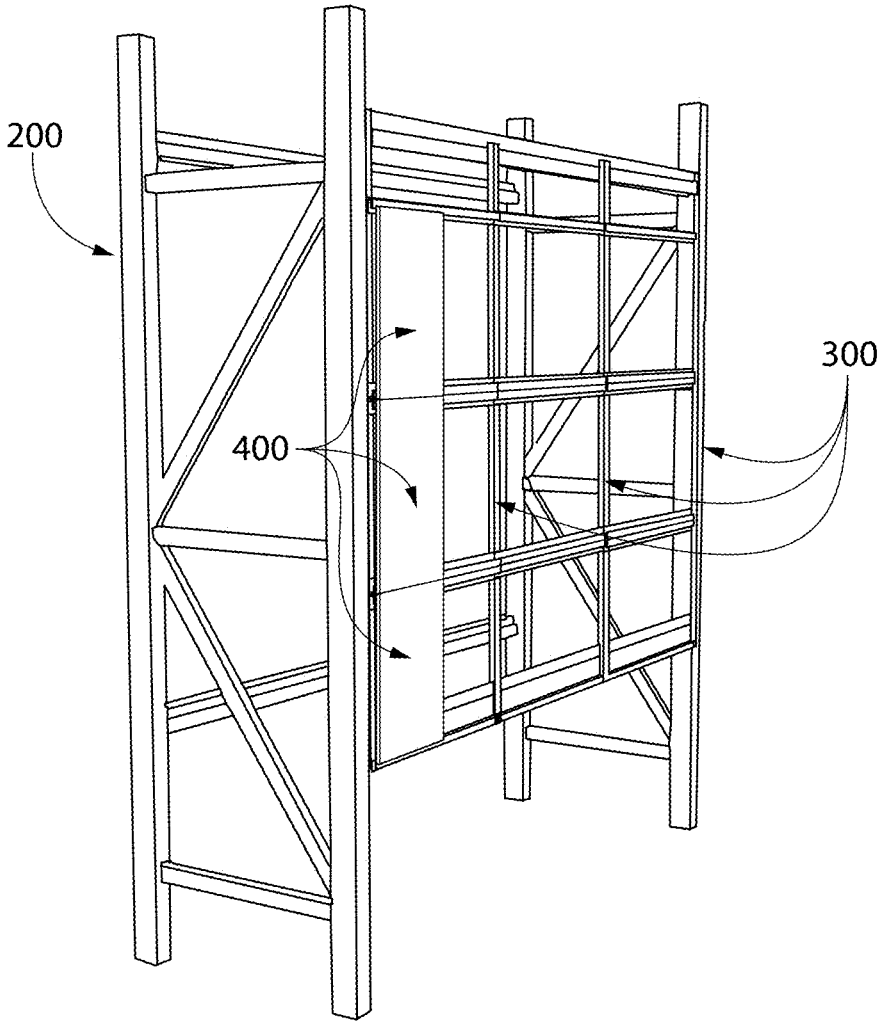
FIG. 12 is a perspective view of a single bay rack showing three carriers and three flat articles installed one above the other.
Figure 16:
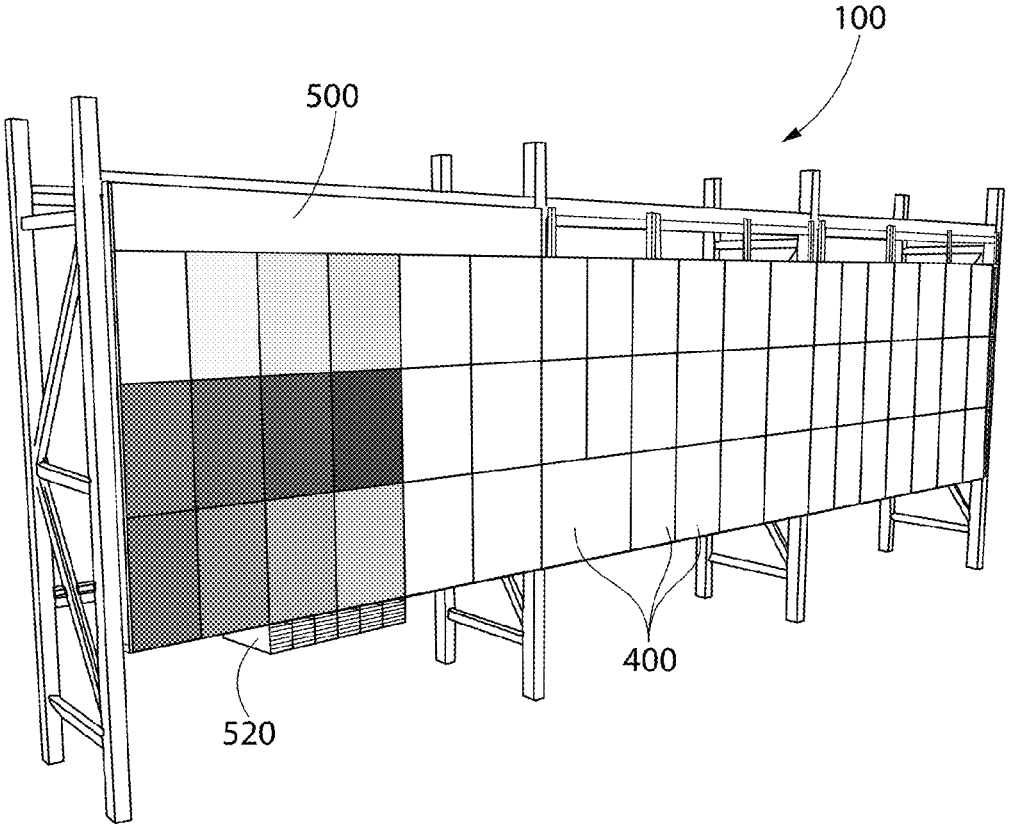
FIG. 16 is a perspective view of the flat article display system showing the header securing the flat articles and a plurality of flat articles.

The exemplary embodiment of the carrier 300 has three pairs of support members 308 extending between the upright members 306. These three pairs of support members 308 permit the mounting of three rows of flat articles 400 as shown in FIGS. 12 and 16. Each row may be substantially continuous or may be interrupted by gaps between flat articles 400. Due to the fact that the flat articles 400 are slid downward to lock them into place, the flat articles 400 on lower rows may be fixed in position by assembling the lowest row first, followed by the next row up, and so forth. Flat articles 400 are then locked into place, and cannot be removed without disassembling all rows above. As installed, the front faces 410 of the flat articles 400 are substantially coplanar. The topmost row of flat articles 400 can be further secured by a header 500. This header 500 secures to the carrier 300 using conventional fasteners, and is installed after all flat articles 400 are installed in place. The header 500 may display advertising information such as the trade name, manufacturer, product line, or any other useful information while simultaneously hiding the carrier 300 behind it. This provides a clean appearance to the customer, who can view various samples of flooring materials with a minimum of visual disruption.

Figure 13A:
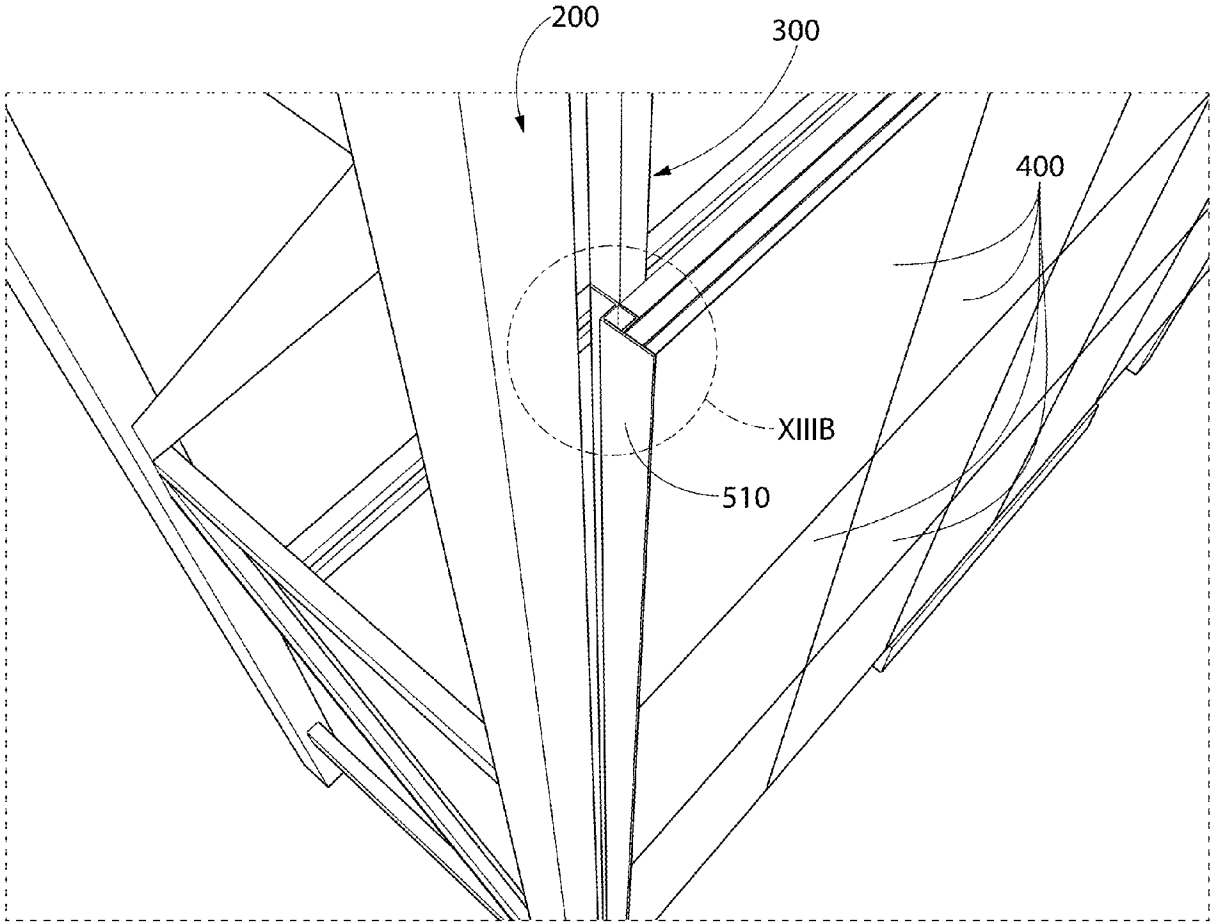
FIG. 13A is a top perspective view of a formed metal edge used to prevent removal of flat articles.
Figure 13B:
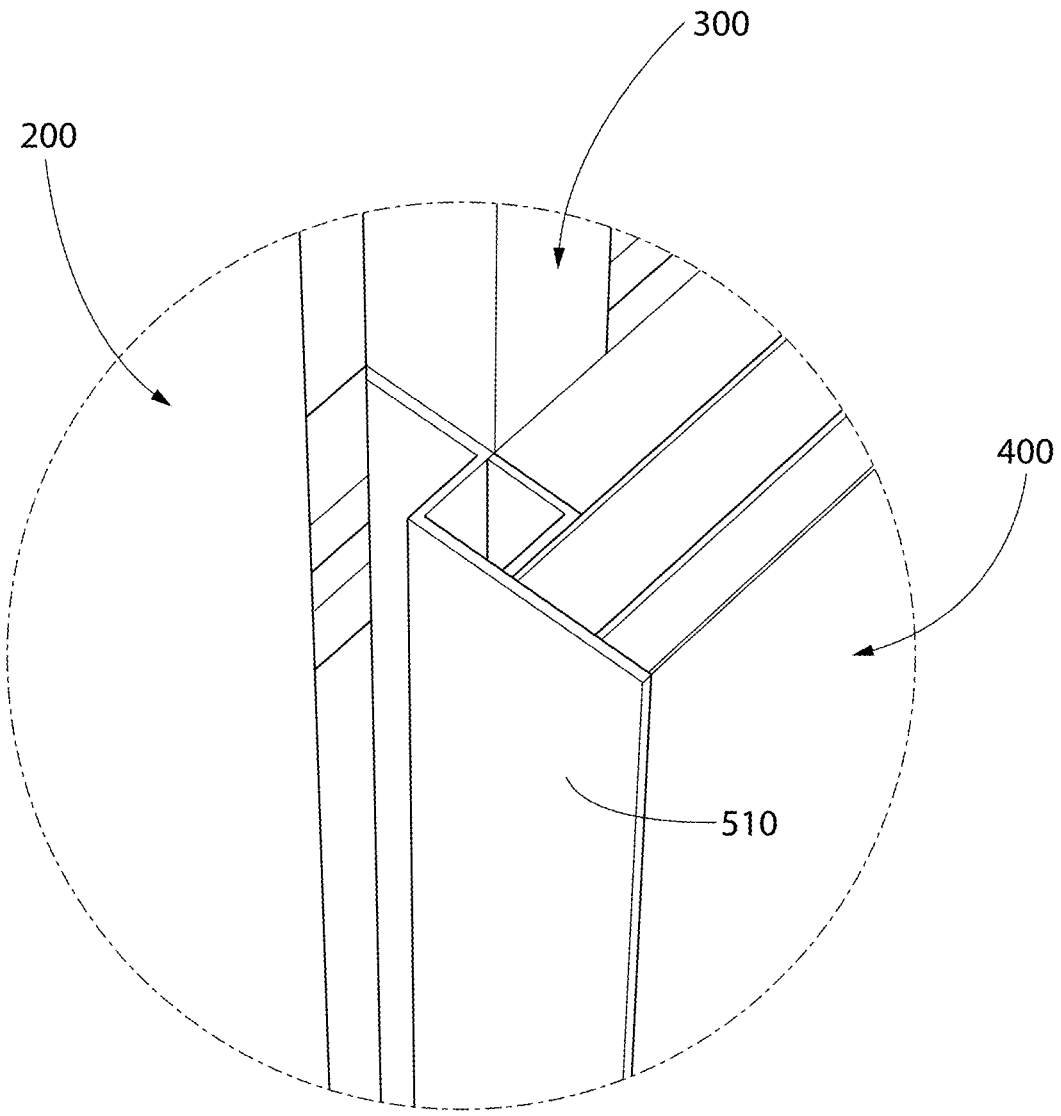
FIG. 13B is an enlarged top perspective view of the formed metal edge.

Though the header 500 prevents withdrawal of flat articles 400 by sliding them upward and withdrawing them, the flat articles 400 may still be slid horizontally along the carrier. As shown in FIGS. 13A and 13B, a formed metal edge 510 is provided. This formed metal edge 510 is secured to the carrier 300, providing a clean appearance when the ends of the system 100 are viewed, and preventing withdrawal of flat articles 400. This formed metal edge 510 hides the product mounting elements 402, the carrier 300, and the first side edge and the second side edge 418, 420 of the display material. It may be fastened to the carrier 300 by any conventional means, including screws or bolts.

As best shown in FIGS. 15A and 15B, the first pair of support members 308 of the carrier 300 protrude beyond the front-most face 230 of the rack 200 in a direction away from the rack 200 when the carrier 300 is installed on the rack 200. The flat articles 400 may be installed in the carriers 300 and span multiple carriers 300. In the exemplary embodiment, the flat articles 400 may extend beyond the carrier 400 in the horizontal direction so that the flat articles 400 overly and at least partially conceal a vertical rack support 202. Thus, a flat article 400 may span a carrier 300 installed in a first bay 210 and another carrier 300 installed in a second bay 210 in horizontal alignment with the carrier 300 installed in the first bay 210. Alternately, the flat article 400 may merely extend beyond a first carrier 300 and partially conceal a vertical rack support 202 without engaging a second carrier 300. The flat articles 400 do not need to abut each other along each row, and may have a space or gap between them if desired. Alternately, the flat articles 400 may abut each other and form a continuous uninterrupted surface (i.e., wall) of wood or other flooring material. This continuous uninterrupted surface may span as many bays as desired, and the header 500 may be dimensioned to span the entire wall surface, either in segments or in one continuous piece.

In some embodiments, the flat articles 400 may also be arranged such that the flat articles 400 above and below each row have a gap or space between them. In alternate embodiments, the flat articles 400 are arranged such that they are in abutment in the vertical direction, forming a continuous uninterrupted column. Thus, a continuous uninterrupted surface may be formed both along a row and along a column if desired, with the flat articles 400 in abutment in both the rows and the columns.

Figure 14:
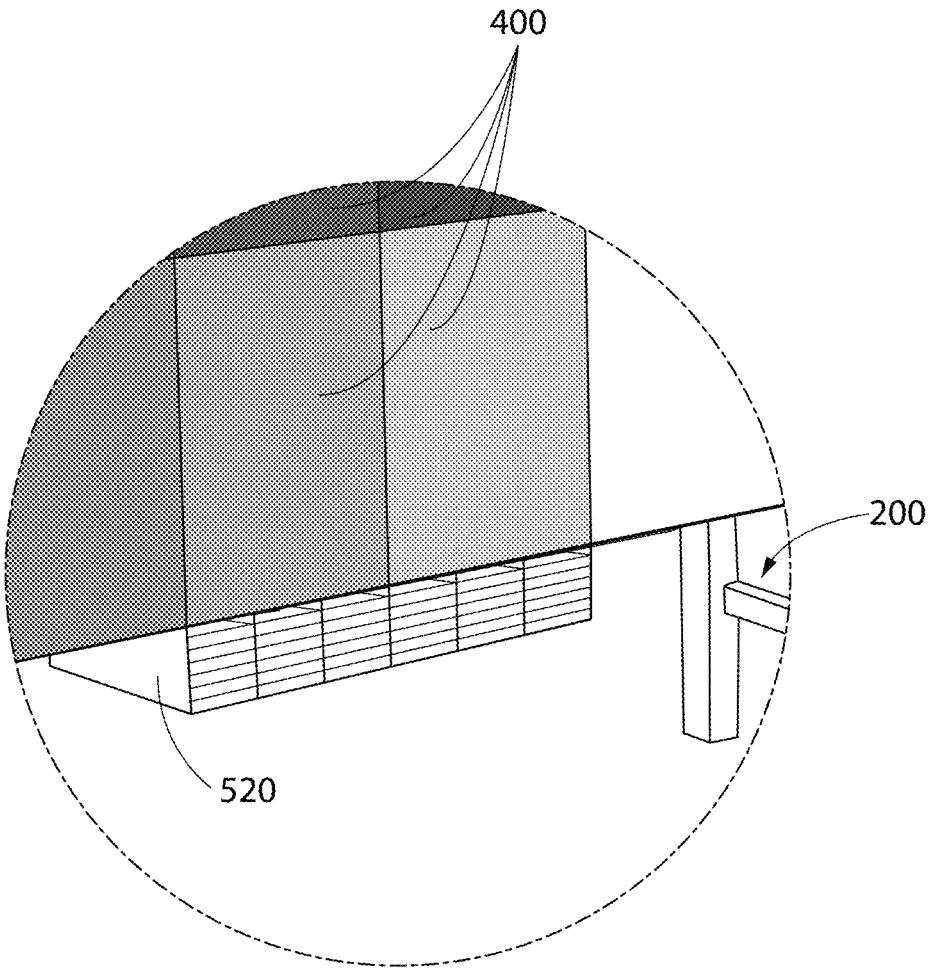
FIG. 14 is an enlarged perspective view of a rack used to display take-home samples.

Additional horizontal support members 204 may be installed to permit the storage of product packages 515 for those products represented by the flat articles 400, as shown in FIG. 1. Further, as shown in FIG. 14, take-home product samples may be displayed in trays 520 below the flat articles 400. These trays 520 may be attached to the carrier 300, or may be supported by horizontal support members 204 as desired.

While the foregoing description and drawings represent exemplary embodiments of the present disclosure, it will be understood that various additions, modifications and substitutions may be made therein without departing from the spirit and scope and range of equivalents of the accompanying claims. In particular, it will be clear to those skilled in the art that the present invention may be embodied in other forms, structures, arrangements, proportions, sizes, and with other elements, materials, and components, without departing from the spirit or essential characteristics thereof. In addition, numerous variations in the methods/processes described herein may be made within the scope of the present disclosure. One skilled in the art will further appreciate that the embodiments may be used with many modifications of structure, arrangement, proportions, sizes, materials, and components and otherwise, used in the practice of the disclosure, which are particularly adapted to specific environments and operative requirements without departing from the principles described herein. The presently disclosed embodiments are therefore to be considered in all respects as illustrative and not restrictive. The appended claims should be construed broadly, to include other variants and embodiments of the disclosure, which may be made by those skilled in the art without departing from the scope and range of equivalents.

What is claimed is:

1. A flat article display system comprising:

a rack comprising:

first and second vertical rack supports arranged in a horizontally spaced-apart manner to define a first bay therebetween;

first upper and lower horizontal rack supports, each of the first upper and lower horizontal rack supports coupled to and extending between the first and second vertical rack supports in a vertically spaced-apart manner;

one or more carriers, each of the carriers comprising:

an upper mounting bracket coupled to the first upper horizontal rack support;

a lower mounting bracket coupled to the first lower horizontal rack support;

a pair of upright members extending between and coupled to each of the upper and lower mounting brackets in a horizontally spaced-apart manner;

a first pair of support members extending between the pair of upright members in a vertically spaced-apart manner; and a second pair of support members extending between the pair of upright members in a vertically spaced-apart manner, the second pair of support members located below the first pair of support members; and a plurality of flat articles mounted to the first and second pairs of support members of the carrier, a first set of the plurality of flat articles mounted to the first pair of support members of the carrier and a second set of the plurality of flat articles mounted to the second pair of support members of the carrier, each of the plurality of flat articles comprises a front surface, the front surfaces of the first and second sets of the plurality of flat articles being substantially coplanar.

2. The flat article display system of claim 1 further comprising, for each of the plurality of flat articles, a pair of product mounting elements coupled to the flat article, the flat article mounted to the carrier through slidable mating between the pair of product mounting elements and one of the first and second pairs of support members.

3. The flat article display system of claim 2 wherein the first pair of support members of the carrier comprises an upper engagement member and a lower engagement member; and wherein for each of the first plurality of flat articles, the pair of product mounting elements comprises an upper channel member and a lower channel member.

4. The flat article display system of claim 1 further comprising:

the lower horizontal rack support comprising a lower front cross-beam;

the upper horizontal rack support comprising an upper front cross-beam;

the upper mounting bracket of the carriers comprising an upper channel member that slidably engages the upper front cross-beam; and the lower mounting bracket of the carriers comprising a fastening element that can be alternated between: (1) an unlocked state in which the lower mounting bracket can be separated from the lower front cross-beam; and (2) a locked state in which the lower mounting bracket is fixed to the lower front cross-beam.

5. The flat article display system of claim 1 wherein for each of the carriers, the first pair of support members protrudes beyond a front-most face of the vertical rack supports of the rack support in a horizontal direction away from the rack.

6. A flat article display system comprising:

a rack comprising:

first and second vertical rack supports arranged in a horizontally spaced-apart manner to define a first bay therebetween;

first upper and lower horizontal rack supports, each of the first upper and lower horizontal rack supports coupled to and extending between the first and second vertical rack supports in a vertically spaced-apart manner;

one or more carriers, each of the carriers comprising:

an upper mounting bracket coupled to the first upper horizontal rack support;

a lower mounting bracket coupled to the first lower horizontal rack support;

a pair of upright members extending between and coupled to each of the upper and lower mounting brackets in a horizontally spaced-apart manner;

a first pair of support members extending between the pair of upright members in a vertically spaced-apart manner;

a plurality of flat articles mounted to the first pair of support members of the carrier, for each of the plurality of flat articles, a pair of product mounting elements coupled to the flat article, the flat article mounted to the carrier through slidable mating between the pair of product mounting elements and the first pair of support members;

wherein the first pair of support members of the carrier comprises an upper engagement member and a lower engagement member; and wherein for each of the first plurality of flat articles, the pair of product mounting elements comprises an upper channel member and a lower channel member; and wherein the upper engagement member of the first pair of support members comprises a downwardly extending engagement wall having a first height and the lower engagement member of the first pair of support members comprises an upwardly extending engagement wall having a second height, the second height being less than the first height.

7. A flat article display system comprising:

a rack comprising:

first and second vertical rack supports arranged in a horizontally spaced-apart manner to define a first bay therebetween;

first upper and lower horizontal rack supports, each of the first upper and lower horizontal rack supports coupled to and extending between the first and second vertical rack supports in a vertically spaced-apart manner;

one or more carriers, each of the carriers comprising:

an upper mounting bracket coupled to the first upper horizontal rack support;

a lower mounting bracket coupled to the first lower horizontal rack support;

a pair of upright members extending between and coupled to each of the upper and lower mounting brackets in a horizontally spaced-apart manner;

a first pair of support members extending between the pair of upright members in a vertically spaced-apart manner;

a plurality of flat articles mounted to the first pair of support members of the carrier, for each of the plurality of flat articles, a pair of product mounting elements coupled to the flat article, the flat article mounted to the carrier through slidable mating between the pair of product mounting elements and the first pair of support members;

wherein the first pair of support members of the carrier comprises an upper engagement member and a lower engagement member; and wherein for each of the first plurality of flat articles, the pair of product mounting elements comprises an upper channel member and a lower channel member; and wherein for each of the plurality of flat articles, the upper channel member of the pair of product mounting elements comprises an upwardly extending engagement wall having a first height and the lower channel member of the pair of product mounting elements comprises a downwardly extending engagement wall having a second height, the second height being less than the first height.

8. A flat article display system comprising:

a rack comprising:

first and second vertical rack supports arranged in a horizontally spaced-apart manner to define a first bay therebetween;

first upper and lower horizontal rack supports, each of the first upper and lower horizontal rack supports coupled to and extending between the first and second vertical rack supports in a vertically spaced-apart manner;

one or more carriers, each of the carriers comprising:

an upper mounting bracket coupled to the first upper horizontal rack support;

a lower mounting bracket coupled to the first lower horizontal rack support;

a pair of upright members extending between and coupled to each of the upper and lower mounting brackets in a horizontally spaced-apart manner;

a first pair of support members extending between the pair of upright members in a vertically spaced-apart manner;

a plurality of flat articles having a pair of product mounting elements coupled thereto for mounting the flat articles to the first pair of support members of the carrier;

wherein the first pair of support members of the carrier comprises an upper engagement member and a lower engagement member; wherein for each of the first plurality of flat articles, the pair of product mounting elements comprises an upper channel member comprising an upper channel having an open bottom and a lower channel member comprising a lower channel having an open top; and wherein for each of the plurality of flat articles, the flat article is mounted to the carrier by: (1) slidably inserting the upper engagement member into the upper channel of the upper channel member; and (2) slidably inserting the lower engagement member into the lower channel of the lower channel member.

9. A flat article display system comprising:

a rack comprising:

first and second vertical rack supports arranged in a horizontally spaced-apart manner to define a first bay therebetween;

first upper and lower horizontal rack supports, each of the first upper and lower horizontal rack supports coupled to and extending between the first and second vertical rack supports in a vertically spaced-apart manner;

one or more carriers, each of the carriers comprising:

an upper mounting bracket coupled to the first upper horizontal rack support;

a lower mounting bracket coupled to the first lower horizontal rack support;

a pair of upright members extending between and coupled to each of the upper and lower mounting brackets in a horizontally spaced-apart manner;

a first pair of support members extending between the pair of upright members in a vertically spaced-apart manner;

a plurality of flat articles mounted to the first pair of support members of the carrier;

a plurality of the carriers mounted to the first upper and lower horizontal rack supports of the rack in the first bay so that the first pairs of support members of adjacent first and second ones of the carriers are in horizontal alignment;

a first set of the plurality of flat articles mounted to the first pair of support members of the first one of the carriers; and a second set of the plurality of flat articles mounted to the first pair of support members of the second one of the carriers, each of the plurality of flat articles comprising a front surface, the front surfaces of the first and second sets of the plurality of flat articles being substantially coplanar and in abutment with one another.

10. A flat article display system comprising:

a rack comprising:

first, second, and third vertical rack supports arranged in a horizontally spaced-apart manner to define a first bay between the first and second rack supports and a second bay between the second and third rack supports;

a plurality of carriers, each of the carriers comprising:

a pair of upright members arranged in a horizontally spaced-apart manner;

a first pair of support members extending between the pair of upright members in a vertically spaced-apart manner, the first pair of support members comprising an upper engagement member and a lower engagement member;

a first one of the carriers mounted to the rack in the first bay on one side of the second vertical rack support and a second one of the carriers mounted to the rack in the second bay on an opposite side of the second vertical rack support, the first pairs of support members of the first and second ones of the carriers being in horizontal alignment;

a plurality of flat articles mounted to the first pairs of support members of the first and second ones of the carriers to form a continuous row of flat articles that overlie and at least partially conceal the second vertical rack support;

a pair of product mounting elements coupled to each of the flat articles, the pair of product mounting elements comprising an upper channel member comprising an upper channel having an open bottom and a lower channel member comprising a lower channel having an open top;

wherein for each of the flat articles, the flat articles is mounted to the carrier by: (1) slidably inserting the upper engagement member into the upper channel of the upper channel member; and (2) slidably inserting the lower engagement member into the lower channel of the lower channel member.

11. The flat article display system of claim 10 wherein the plurality of flat articles comprises a flat article that is mounted to both the first pair of support members of the first one of the carriers and the first pair of support members of the second one of the carriers.

12. The flat article display system of claim 10 wherein each of the flat articles comprises a first side edge, a second side edge opposite the first side edge, and a front surface; wherein for each of the flat articles in the continuous row, the first side edge of the flat article abuts the second side edge of an adjacent flat article in the continuous row, thereby forming an uninterrupted row of the flat articles that extends across at least a portion of each of the first and second bays; and wherein the front surfaces of the flat articles in the continuous row are substantially coplanar with one another.

13. The flat article display system of claim 10 wherein each of the flat articles comprises a center point; and wherein the center points of the flat articles in the continuous row are substantially equidistant from one another.

* * * * *